US008288933B2

(12) United States Patent
Li

(10) Patent No.: US 8,288,933 B2
(45) Date of Patent: Oct. 16, 2012

(54) LAMP WITH ENERGY-SAVING HIGH-POWER SPIRAL LIGHT TUBE

(75) Inventor: Yang Li, Shangyu (CN)

(73) Assignee: Zhejiang Yankon Group Co. Ltd., Shangyu (CN)

( * ) Notice: Subject to any disclaimer, the term of this patent is extended or adjusted under 35 U.S.C. 154(b) by 74 days.

(21) Appl. No.: 12/881,202

(22) Filed: Sep. 14, 2010

(65) Prior Publication Data

US 2011/0156585 A1 Jun. 30, 2011

(30) Foreign Application Priority Data

Dec. 29, 2009 (CN) ..... 2009 1 0157050
Dec. 29, 2009 (CN) ..... 2009 1 0157051

(51) Int. Cl.
*H01J 7/44* (2006.01)

(52) U.S. Cl. ..... 313/318.01; 313/318.02; 313/318.03; 313/318.04; 445/22; 445/26; 445/27; 439/226; 315/35

(58) Field of Classification Search ..... 313/318.01–318.04, 25, 26; 439/226; 445/22, 26–27
See application file for complete search history.

(56) References Cited

U.S. PATENT DOCUMENTS 6,316,872 B1 * 11/2001 Ge et al. ..... 313/493
2006/0006781 A1 * 1/2006 Iida et al. ..... 313/318.01
2007/0029914 A1 * 2/2007 Kwong ..... 313/318.01

* cited by examiner

*Primary Examiner* — Tracie Y Green
(74) *Attorney, Agent, or Firm* — Matthias Scholl P.C.; Matthias Scholl

(57) ABSTRACT

An energy-saving lamp with a high-power double spiral energy-saving light tube. The double spiral energy-saving light tube includes two single spiral light tubes having complementary structure. One spiral light tube rotates into the other in the same direction, they geometrically fit into one another, and they complement one another. The two light tubes work independently. Reliability is improved. Short glass tubes can be used for producing the two single spiral light tubes, and the production process is simple and suitable for mass production. The luminous efficiency of the energy-saving lamp of the invention exceeds 80 lm/W. A single spiral light tube of between 14 and 22 mm in diameter corresponds to the power of the lamp of between 100 and 250 W.

1 Claim, 9 Drawing Sheets

LAMP WITH ENERGY-SAVING HIGH-POWER SPIRAL LIGHT TUBE

CROSS-REFERENCE TO RELATED APPLICATIONS

Pursuant to 35 U.S.C. §119 and the Paris Convention Treaty, this application claims the benefit of Chinese Patent Application No. 200910157050.X filed Dec. 29, 2009, and Chinese Patent Application No. 200910157051.4 filed Dec. 29, 2009, the contents of which are incorporated herein by reference.

BACKGROUND OF THE INVENTION

1. Field of the Invention

The invention relates to an energy-saving lamp, and more particularly to an energy-saving lamp with high-power spiral energy-saving light tube.

2. Description of the Related Art

Energy-saving lamps, with multiple types and advantages such as high luminous efficiency, long service life, environmental friendliness, good color, and compact structure, are increasingly popular by consumers. Spiral energy-saving lamps, particularly high-power spiral energy-saving lamps, are a common type. Due to advantages of high efficiency and energy-saving, they are widely used for indoor or outdoor lighting. Conventional energy-saving lamps include a lamp holder, an upper cover, a lower cover, a ballast, and an energy-saving light tube. The ballast is disposed inside the upper cover and the energy-saving light tube is fixedly connected to the lower cover. The energy-saving light tube is generally double spiral and has high power which is achieved by extending the length thereof. However, the longer the light tube, the higher the tube voltage. Too much high tube voltage causes the drive match between the ballast and the light tube to be unreliable. Second, to produce a high-power double spiral energy-saving light tube, long glass tubes are required and need to be curved in large scale by heating. Thus, the production process is very difficult and hardly suitable for mass production. In addition, the temperature of the tube wall of the high-power double spiral energy-saving light tube is very high, if a cold end is provided by conventional methods, for example, protruding from the top of the tube, the temperature of the cold end is difficult to control, which will greatly weaken the luminous efficiency.

SUMMARY OF THE INVENTION

In view of the above-described problems, it is one objective of the invention to provide an energy-saving lamp with a high-power double spiral energy-saving light tube that easily matches with a driving circuit, has high luminous flux and high luminous efficiency, and is suitable for mass production.

To achieve the above objectives, in accordance with one embodiment of the invention, there is provided an energy-saving lamp comprising a lamp holder, an upper cover comprising two oblique interfaces, a lower cover, a ballast, a double spiral energy-saving light tube comprising a first single spiral light tube and a second single spiral light tube, a fixing device, and a connecting device, wherein the two oblique interfaces are connect to the lower cover and cooperate with one end of the first single spiral light tube and of the second single spiral light tube, respectively; the first and second spiral energy-saving light tubes have the same structure and are cylindrical; the first single spiral light tube rotates into the second spiral light tube following the same direction, whereby forming a cylindrical complex; the fixing device is disposed on the cylindrical complex for supporting and fixing the first and second single spiral light tube; one end of the first single spiral light tube and of the second single spiral light tube at one end of the central axis of the complex is received by the two oblique interfaces, respectively; and the connecting device for accommodating lamp wires is disposed between the lower cover and another end of the first and second single spiral light tube at the other end of the central axis of the complex.

In a class of this embodiment, a first end of the first single spiral light tube and of the second single spiral light tube is disposed at one end of the central axis of the complex and received by the two oblique interfaces, respectively; a first exhaust tube and a first filament are disposed on the first end of the first single spiral light tube; a third exhaust tube and a third filament are disposed on the first end of the second single spiral light tube; a second end of the first single spiral light tube and of the second single spiral light tube is disposed at the other end of the central axis of the complex; the connecting device is disposed between the lower cover and the second end of the first single spiral light tube and of the second single spiral light tube; a second exhaust tube and a second filament are disposed on the second end of the first single spiral light tube; a fourth exhaust tube and a fourth filament are disposed on the second end of the second single spiral light tube; an amalgam is disposed in the second and fourth exhaust tubes; and the second end of the first and second single spiral light tube comprises a cold end.

In a class of this embodiment, at least a heat dissipation layer is disposed between the upper cover and the lower cover; the heat dissipation layer comprises a casing; a heat dissipation chamber is disposed in the casing; a plurality of holes for heat dissipation are disposed on the circumferential wall of the casing; and the holes and the heat dissipation chamber are connected.

In a class of this embodiment, the fixing device comprises at least two columns of fixing parts disposed on the complex; the fixing parts are disposed between the first single spiral light tube and the second single spiral light tube and coated with an adhesive; and the first single spiral light tube and the second single spiral light tube are fixedly connected by the adhesive coated on the fixing parts.

In a class of this embodiment, the fixing device comprises two columns of the fixing parts which are disposed symmetrically on each side of the central axis of the complex.

In a class of this embodiment, each column comprises two fixing parts; and the two fixing parts are distributed between the first single spiral light tube and the second single spiral light tube at each end of the complex, respectively.

In a class of this embodiment, the fixing device comprises a plurality of fixing parts disposed randomly on the complex; the fixing parts are disposed between the first single spiral light tube and the second single spiral light tube and coated with an adhesive; and the first single spiral light tube and the second single spiral light tube are fixedly connected by the adhesive coated on the fixing parts.

In a class of this embodiment, the fixing parts are a short hollow or solid transparent tube.

In a class of this embodiment, the short transparent tube is a short glass tube.

In a class of this embodiment, the connecting device comprises a lateral support and at least one hollow standpipe; the lateral support comprises an upper bracket and a lower bracket cooperating therewith; on one end of the upper bracket disposed is a first upper groove unit whose cross-section is semi-circular, and on the other end of the upper bracket disposed is a second upper groove unit whose cross-section is semi-circular; on one end of the lower bracket disposed is a first lower groove unit whose cross-section is semi-circular, and on the other end of the lower bracket disposed is a second lower groove unit whose cross-section is semi-circular; the first upper groove unit and the first lower groove unit cooperate with each other to form a first light tube interface; the second upper groove unit and the second lower groove unit cooperate with each other to form a second light tube interface; the whole standpipe is disposed in a chamber formed by the center of the complex, one end thereof is connected to the upper bracket, and the other end thereof passes the bottom of the lower cover and enters the lower cover; the second end of the first single spiral light tube is embedded into and cooperates with the first light tube interface; the second end of the second single spiral light tube is embedded into and cooperates with the second light tube interface; and the second and fourth filaments are connected to the ballast via the lamp wires disposed in the lateral support and the standpipe.

In a class of this embodiment, an upper connector is disposed on the upper bracket; a lower connector is disposed on the lower bracket and cooperates with the upper bracket; and a fixing groove is disposed on the upper connector for fixing one end of the standpipe and connecting the lateral support with the standpipe.

In a class of this embodiment, a first filament connecting plate is disposed in one oblique interface receiving the first end of the first single spiral light tube; the first filament is connected to the first filament connecting plate; the first filament connecting plate is connected to the ballast via the lamp wires; a second filament connecting plate is disposed in the other oblique interface receiving the first end of the second single spiral light tube; the third filament is connected to the second filament connecting plate; and the second filament connecting plate is connected to the ballast via the lamp wires.

In a class of this embodiment, the oblique interface comprises an upper cover unit and a lower base cooperating therewith; a first semi-circular groove is disposed on the upper cover unit; a second semi-circular groove is disposed on the lower base; the first semi-circular groove cooperates with the second semi-circular groove to form an interface groove matching the first end of the first or second single spiral light tube.

Advantages of the invention are summarized below:

1. The double spiral energy-saving light tube comprises two single spiral light tubes with the same structure; the first single spiral light tube rotates into the second spiral light tube following the same direction, whereby forming a cylindrical complex; the fixing device is disposed on the cylindrical complex to fix the two single spiral light tubes to be a double spiral energy-saving light tube; the two single spiral light tubes work independently; thus, as far as the driving circuit is concerned, it is equal to cut conventional double spiral energy-saving light tubes by half, which benefits the drive match between the ballast and the light tubes and improves the reliability thereof; the double spiral energy-saving light tube is composed of the two single spiral light tubes, and conventional short glass tubes can meet the requirement for producing the two single spiral light tubes, thus, the production process is simple and suitable for mass production; the luminous efficiency of the energy-saving lamps of the invention exceeds 80 lm/W; when the single spiral light tube is between 14 and 22 mm in diameter, the power of the lamp is between 100 and 250 W; one end of the two single spiral light tube at one end of the central axis of the complex is connected to the lower cover via the two oblique interfaces; the other end of the two single spiral light tube at the other end of the central axis of the complex is connected to the lower cover via the connecting device;

2. The end of the first and second single spiral light tube comprising amalgam is the cold end; the cold end is disposed in the lower end of the double spiral energy-saving lamp, when the lamp working, the heat produced dissipates upwards, which ensures the temperature of the lower end is the lowest and hardly affected by the temperature of the lamp; the temperature of the cold end can be controlled by regulating the length of the exhaust tube of the single spiral light tube; an amalgam, exhibiting the optimum mercury vapor pressure at corresponding temperature, is selected so that the double spiral lamp exhibits better luminous efficacy than conventional double spiral lamps;

3. The fixing device comprises at least two columns of fixing parts disposed on the complex; the fixing parts are disposed between the first single spiral light tube and the second single spiral light tube and coated with an adhesive; the first single spiral light tube and the second single spiral light tube are fixedly connected by the adhesive coated on the fixing parts; in practice, two columns of the fixing parts are disposed symmetrically on each side of the central axis of the complex, and each column comprises a plurality of the fixing parts; if each column comprises only two fixing parts, one is disposed between the two single spiral light tube at one end of the central axis of the complex, and the other is disposed between the two single spiral light tube at the other end of the central axis of the complex, whereby ensuring the reliability of the connection; in practice, a plurality of the fixing parts are disposed randomly on the complex, as long as the connection between the two single spiral light tube is reliable; the fixing parts are a short hollow or solid transparent tube, for example, a short glass tube; and 4. The connecting device comprises a lateral support and at least one hollow standpipe; at each end of the lateral support disposed is the light tube interface cooperating with the end of the single spiral light tube comprising amalgam; the light tube interface effectively protects the cold end; the filaments of the two single spiral light tubes at the end comprising amalgam are connected to the ballast via the lamp wires in the standpipe; the standpipe accommodates and protects the lamp wires so that the lamp wires are not exposed, which ensures the good appearance of the lamp; in practice, two standpipes can be disposed for accommodating the lamp wires of the two single spiral light tubes, respectively.

BRIEF DESCRIPTION OF THE DRAWINGS

The invention is described hereinbelow with reference to accompanying drawings, in which.

DETAILED DESCRIPTION OF THE EMBODIMENTS

For further illustrating the invention, experiments detailing an energy-saving lamp with high-power spiral energy-saving light tube are described below. It should be noted that the following examples are intended to describe and not to limit the invention.

Figure 1:
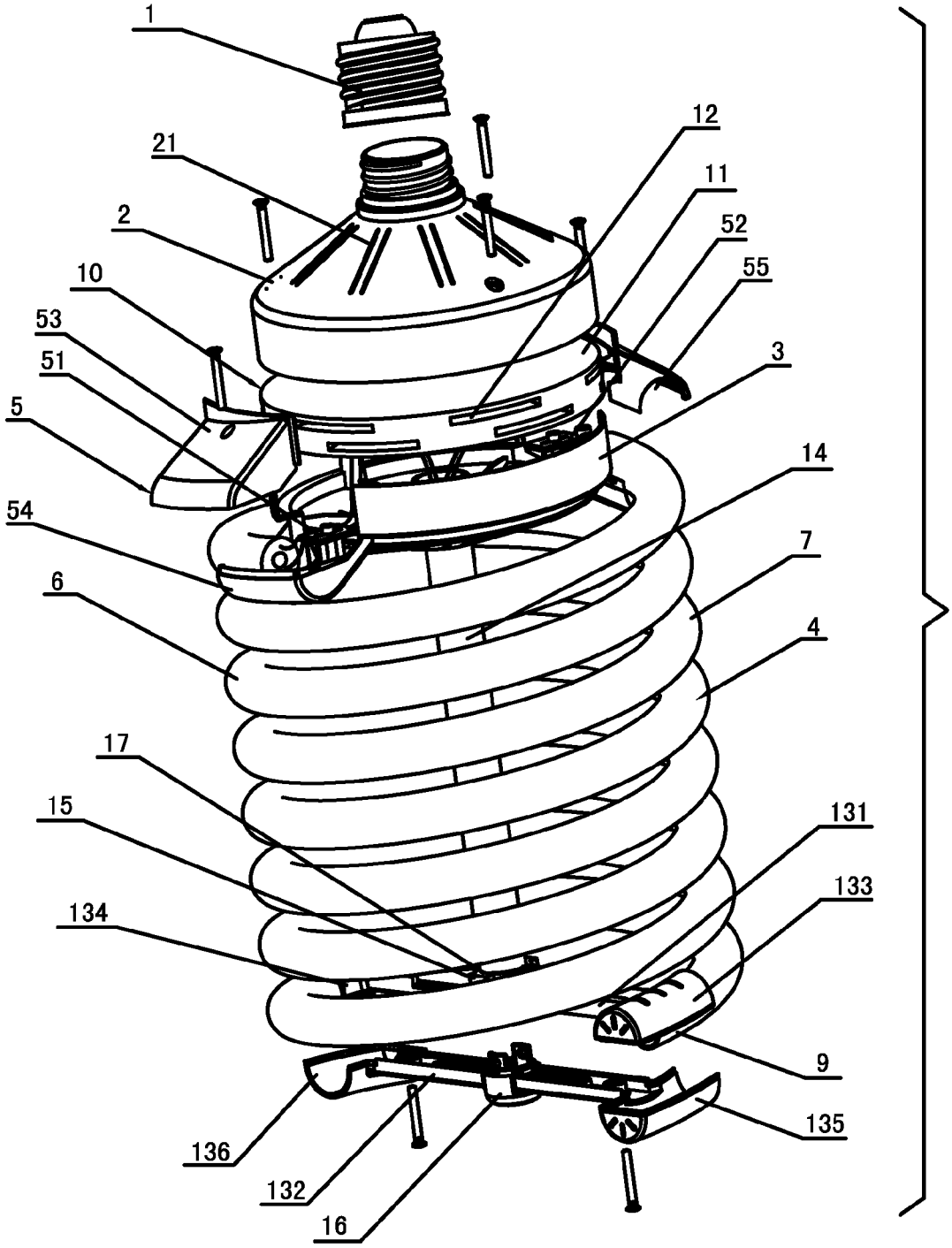
FIG. 1 is an assembly diagram of an energy-saving lamp according to one embodiment of the invention.
Figure 2:
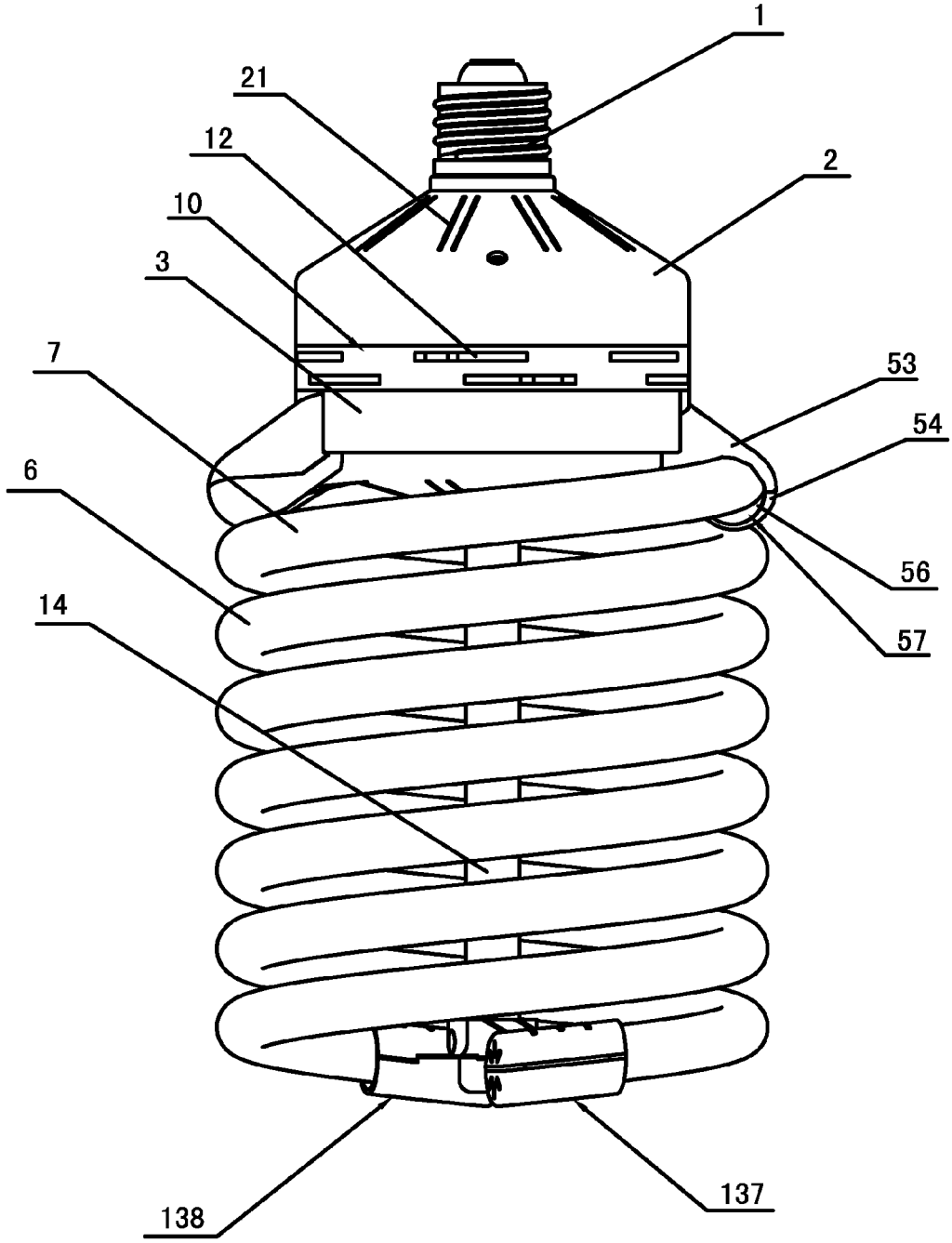
FIG. 2 is a schematic diagram of the overall structure of an energy-saving lamp according to one embodiment of the invention.
Figure 3:
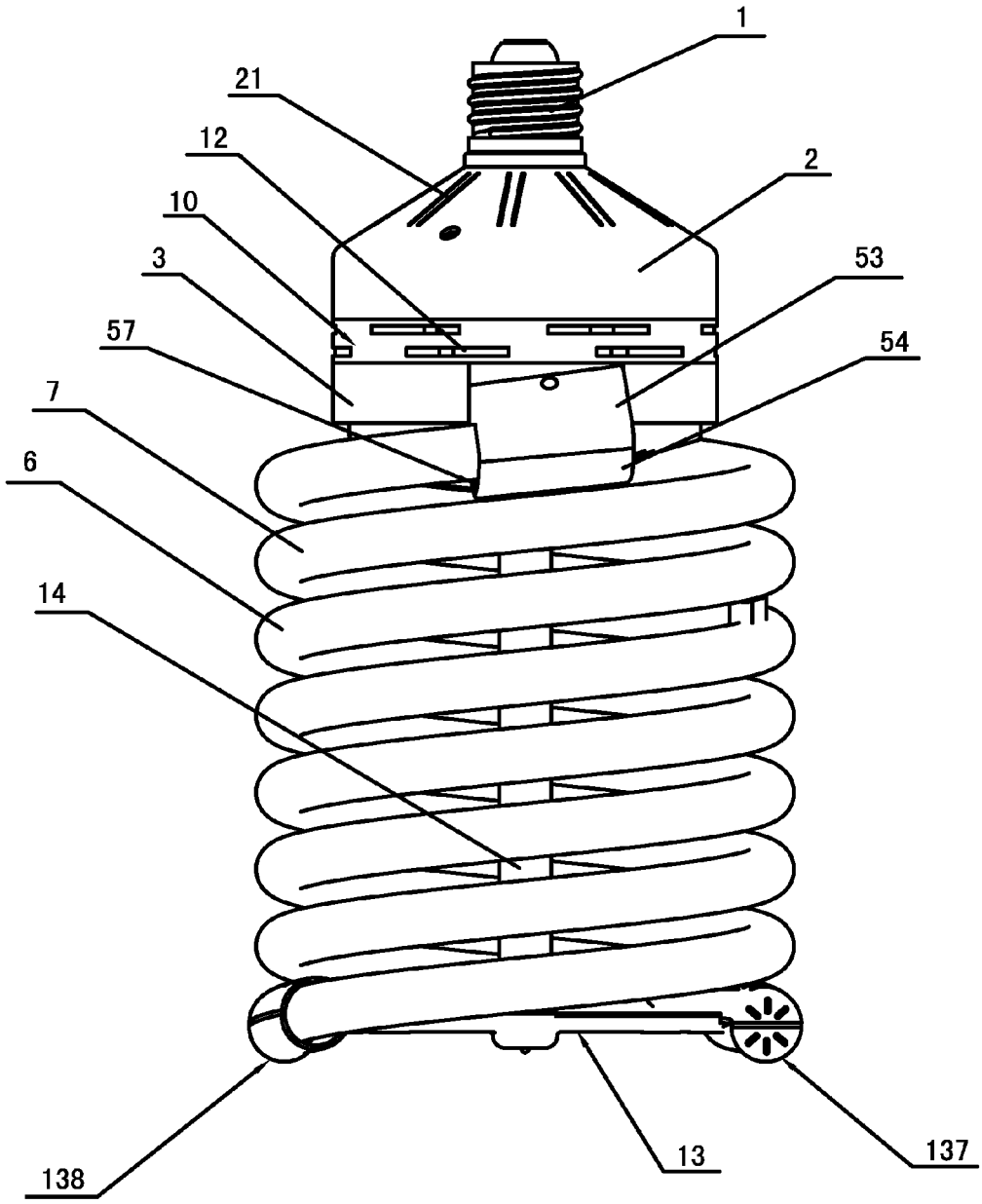
FIG. 3 is a schematic diagram of the overall structure of another energy-saving lamp according to one embodiment of the invention.
Figure 4:
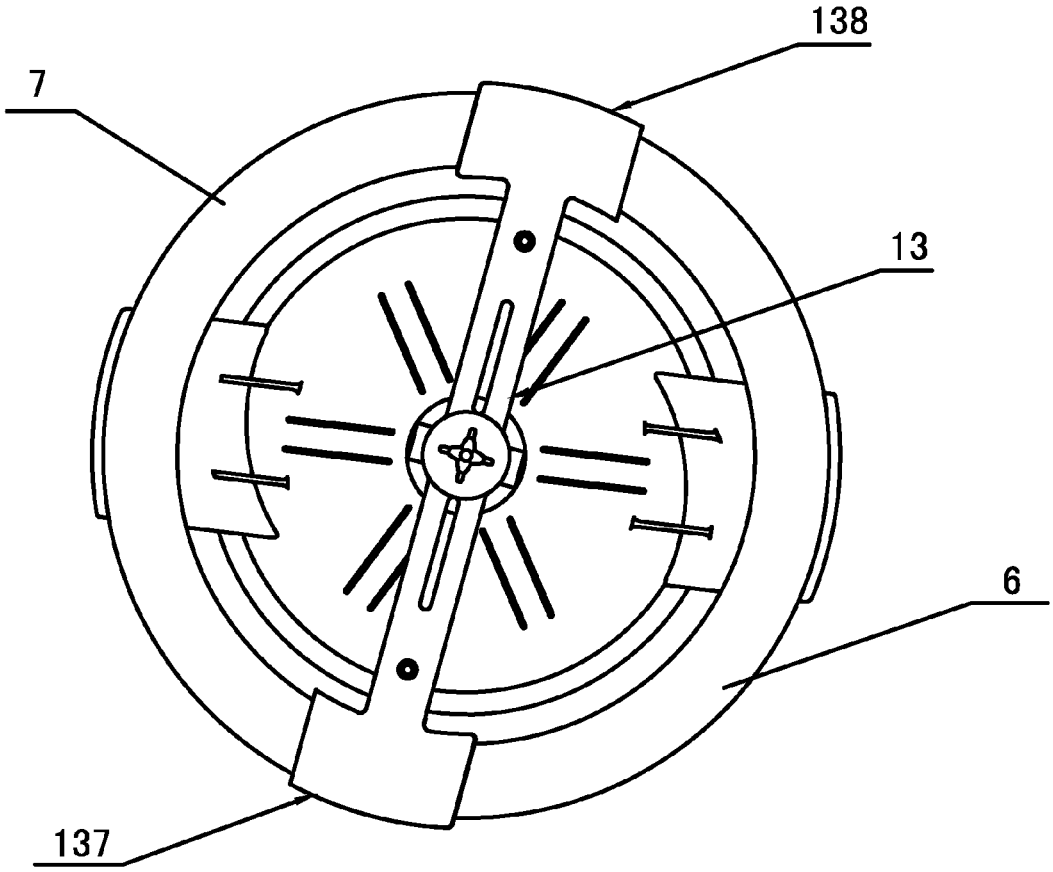
FIG. 4 is a bottom view of an energy-saving lamp according to one embodiment of the invention.
Figure 5:
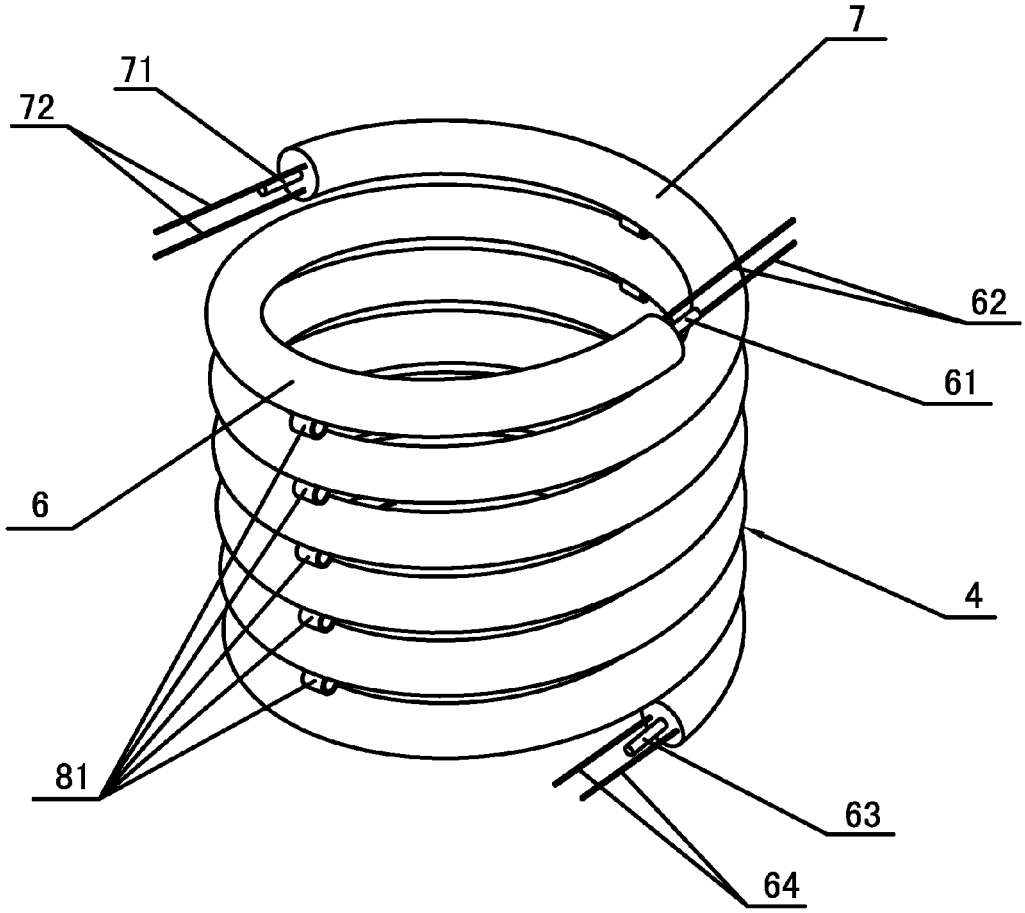
FIG. 5 is a schematic diagram of three-dimensional structure of a double spiral energy-saving light tube of an energy-saving lamp according to one embodiment of the invention.
Figure 6:
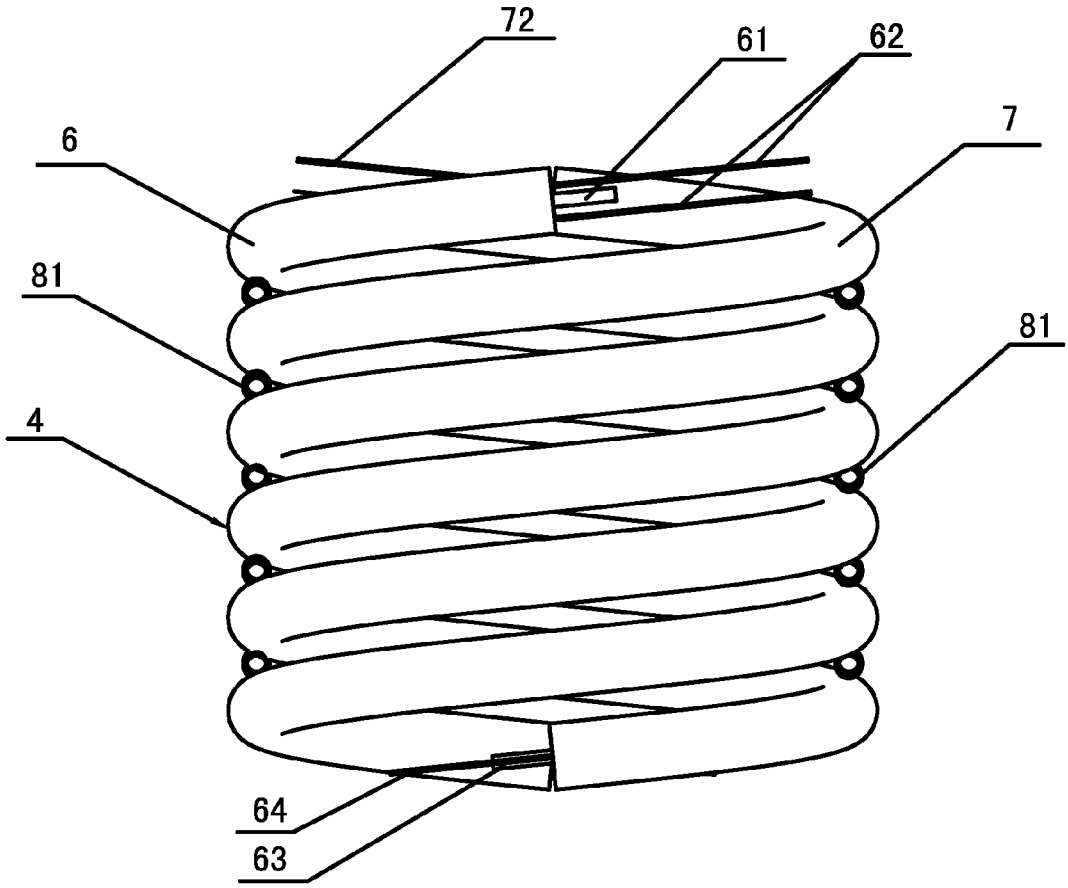
FIG. 6 is a schematic diagram of a double spiral energy-saving light tube of an energy-saving lamp according to one embodiment of the invention.
Figure 7:
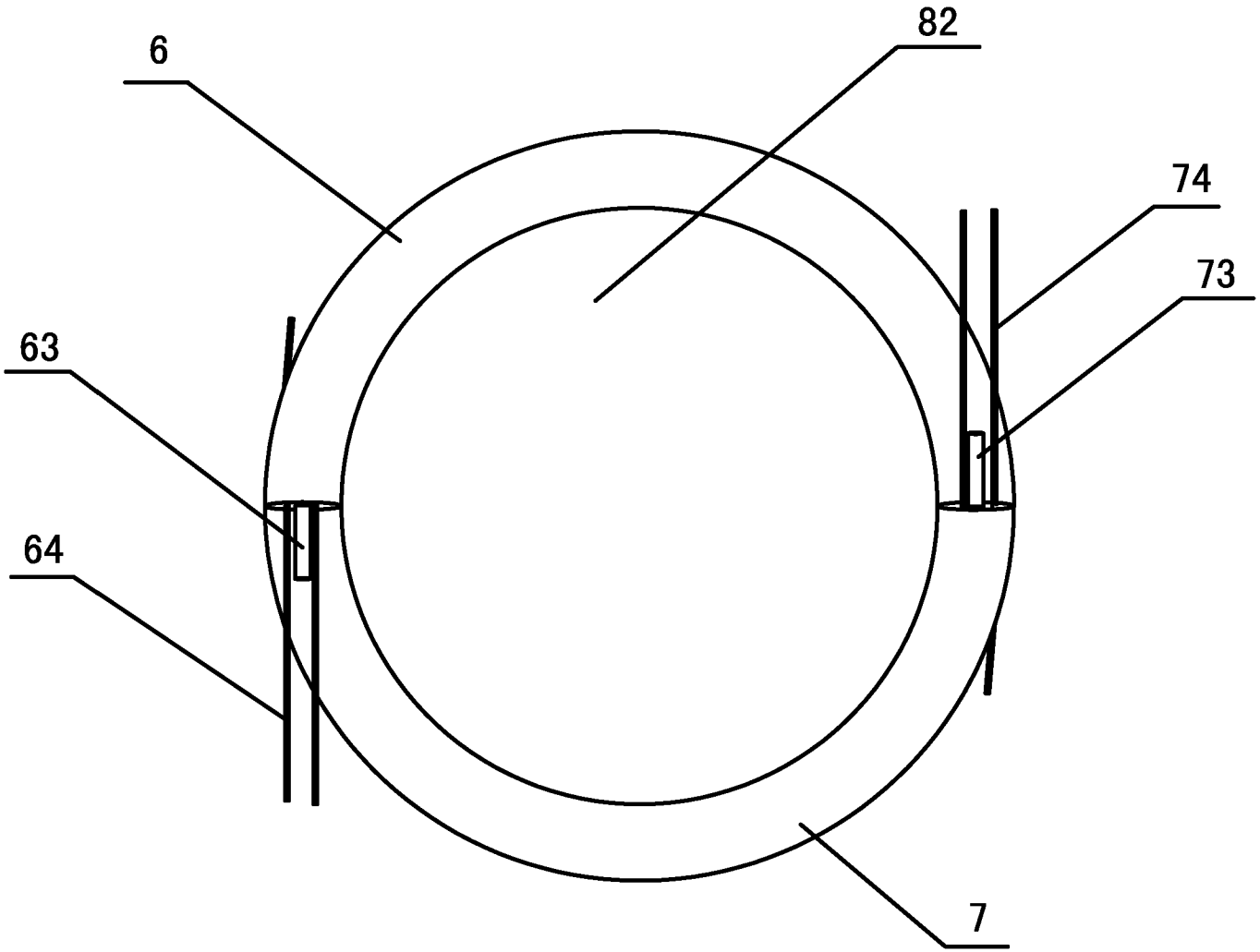
FIG. 7 is a bottom view of a double spiral energy-saving light tube of an energy-saving lamp according to one embodiment of the invention.
Figure 8:
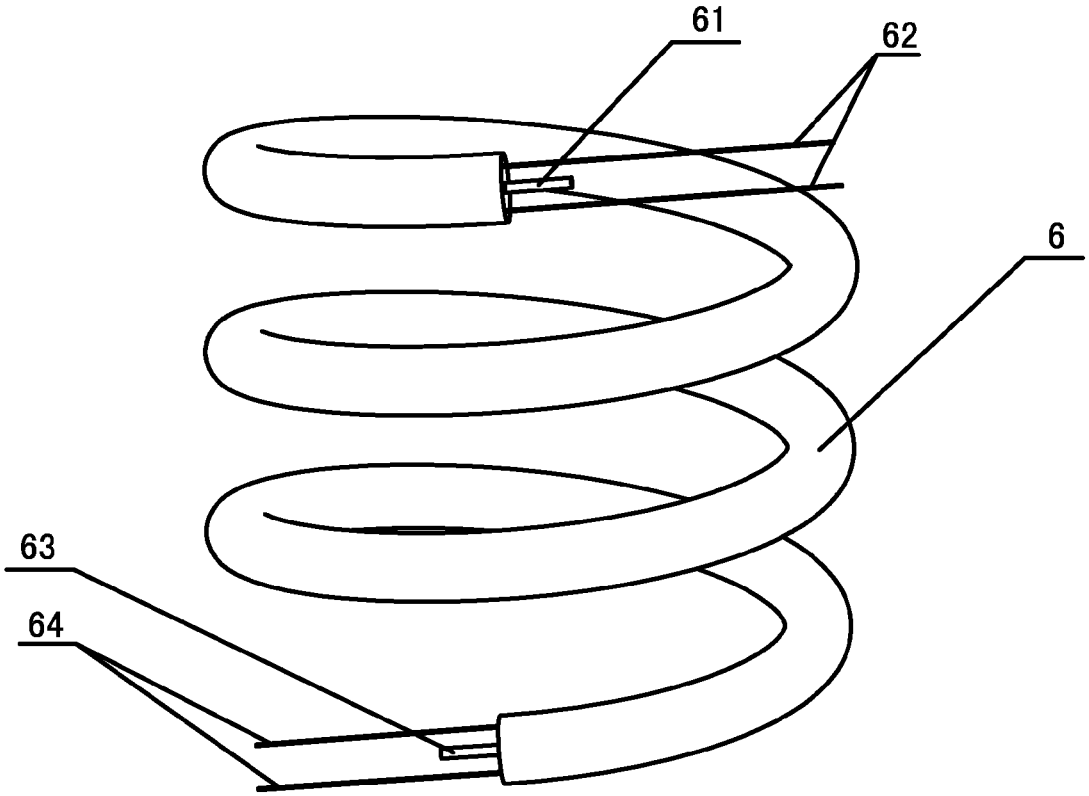
FIG. 8 is a schematic diagram of three-dimensional structure of a single spiral light tube of a double spiral energy-saving light tube according to one embodiment of the invention.
Figure 9:
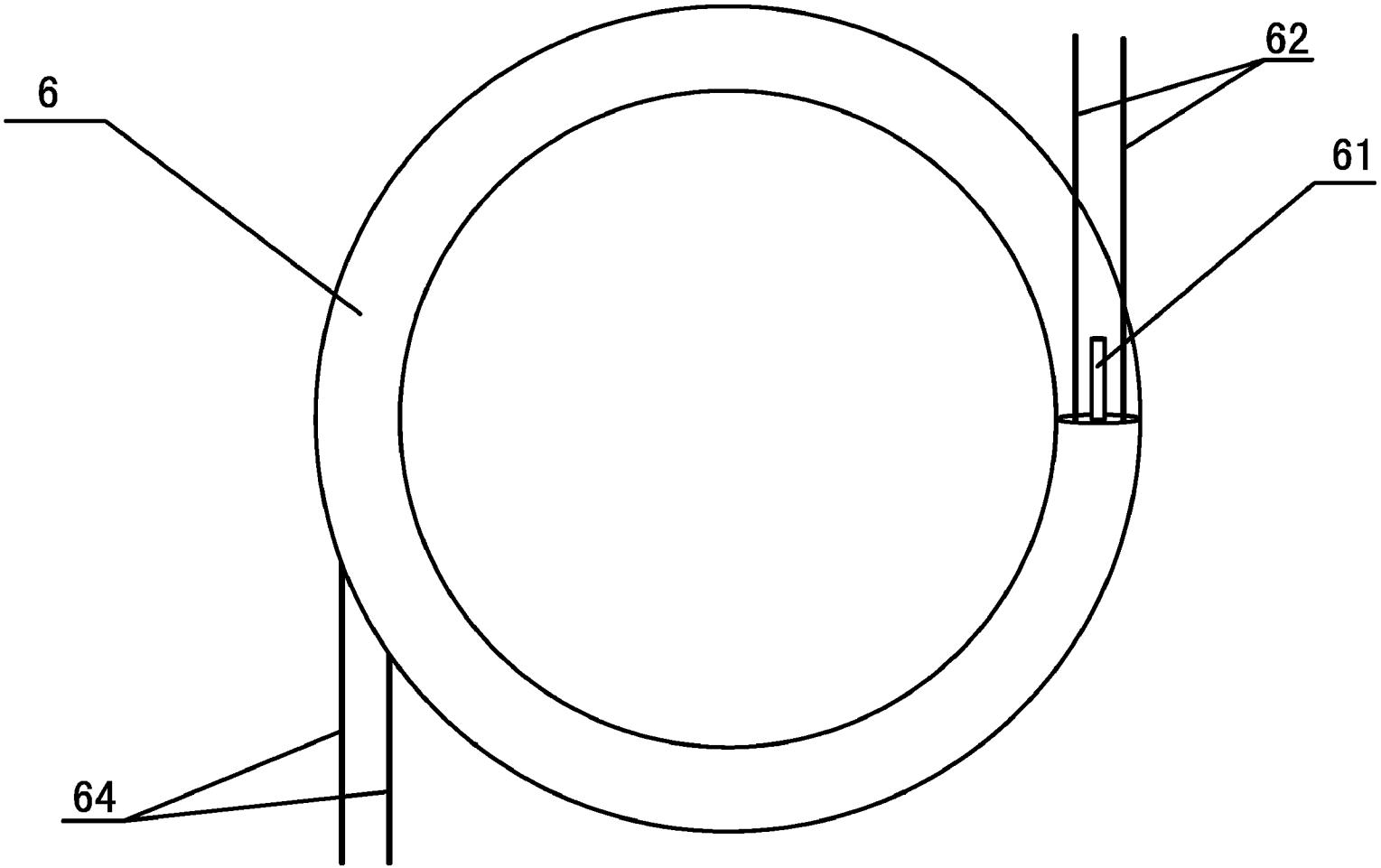
FIG. 9 is a top view of a single spiral light tube of a double spiral energy-saving light tube according to one embodiment of the invention.

As shown in FIGS. 1-9, an energy-saving lamp comprises a lamp holder 1, an upper cover 2 comprising two oblique interfaces 5, a lower cover 3, a ballast (not shown), a double spiral energy-saving light tube 4 comprising a first single spiral light tube 6 and a second single spiral light tube 7, a fixing device, and a connecting device. The upper end of the upper cover 2 is connected to the lamp holder 1. The upper cover 2 is connected to the lower cover 3 by a fastener such as a screw. The two oblique interfaces 5 are connect to the lower cover 3 and cooperate with one end of the first single spiral light tube 6 and the second single spiral light tube 7, respectively. The first and second spiral energy-saving light tubes have the same structure and are cylindrical. FIGS. 8 and 9 show the structure of the single spiral light tube (take the first single spiral light tube as example). The rotational direction of the two single spiral light tubes is both clockwise. The first single spiral light tube 6 rotates clockwisely into the second spiral light tube 7, whereby forming a cylindrical complex. The fixing device is disposed on the cylindrical complex for supporting and fixing the first single spiral light tube 6 and the second single spiral light tube 7. One end of the first single spiral light tube 6 and of the second single spiral light tube 7 at one end of the central axis of the complex is received by the two oblique interfaces 5, respectively. The connecting device for accommodating lamp wires is disposed between the lower cover 3 and another end of the first single spiral light tube 6 and of the second single spiral light tube 7 at the other end of the central axis of the complex.

For preparing the double spiral energy-saving light tube 4, the first single spiral light tube 6 and the second single spiral light tube 7 may be 244 mm in axial length, 196 mm in radial width, and 20 mm in diameter. The vertical distance between the adjacent sections of a single spiral light tube is 56 mm.

A first end of the first single spiral light tube 6 and of the second single spiral light tube 7 are disposed at one end of the central axis of the complex and received by the two oblique interfaces 5, respectively. A first exhaust tube 61 and a first filament 62 are disposed on the first end of the first single spiral light tube 6. A third exhaust tube 71 and a third filament 72 are disposed on the first end of the second single spiral light tube 7. A second end of the first single spiral light tube 6 and of the second single spiral light tube 7 is disposed at the other end of the central axis of the complex. The connecting device is disposed between the lower cover 3 and the second end of the first single spiral light tube 6 and of the second single spiral light tube 7. A second exhaust tube 63 and a second filament 64 are disposed on the second end of the first single spiral light tube 6. A fourth exhaust tube 73 and a fourth filament 74 are disposed on the second end of the second single spiral light tube 7. An amalgam (not shown) is disposed in the second exhaust tube 63 and the fourth exhaust tube 73. The second end of the first single spiral light tube 6 and of second single spiral light tube 7 comprises a cold end 9. The cold end 9 is disposed in the lower end of the double spiral energy-saving lamp. The first end of the first single spiral light tube 6 and of the second single spiral light tube 7 have high temperature. Receiving the first end by the two oblique interfaces 5 effectively prevents the high temperature from passing on to the ballast via the lower cover 3 and affects the service life thereof.

At least a heat dissipation layer 10 is disposed between the upper cover 2 and the lower cover 3. The heat dissipation layer 10 comprises a casing 11. A heat dissipation chamber (not shown) is disposed in the casing 11. A plurality of holes 12 for heat dissipation are disposed on the circumferential wall of the casing 11. The holes 12 and the heat dissipation chamber are connected. To achieve better heat dissipation effect, two heat dissipation layers 10 can be disposed.

Through holes 21 for heat dissipation are disposed on the upper cover 2.

The fixing device comprises at least two columns of fixing parts 81 (not shown in FIGS. 1-4) disposed on the complex. The fixing parts 81 are disposed between the first single spiral light tube 6 and the second single spiral light tube 7 and coated with an adhesive (not shown). The first single spiral light tube 6 and the second single spiral light tube 7 are fixedly connected by the adhesive coated on the fixing parts 81. In practice, the fixing device comprises two columns of the fixing parts 81 which is disposed symmetrically on each side of the central axis of the complex. The fixing parts 81 are two or multiple in number in each column. When it is two, the two fixing parts are distributed between the first single spiral light tube 6 and the second single spiral light tube 7 at each end of the complex, respectively.

The fixing device may comprise a plurality of fixing parts 81 disposed randomly on the complex. The fixing parts 81 are disposed between the first single spiral light tube 6 and the second single spiral light tube 7 and coated with an adhesive. The first single spiral light tube 6 and the second single spiral light tube 7 are fixedly connected by the adhesive coated on the fixing parts 81.

The fixing parts 81 are a short hollow or solid transparent tube. The short transparent tube is a short glass tube. The adhesive is purchased from market and has good adhesion.

The connecting device comprises a lateral support 13 and at least one hollow standpipe 14. The lateral support 13 comprises an upper bracket 131 and a lower bracket 132 cooperating therewith. The upper bracket 131 and the lower bracket 132 are connected by a fastener such as a screw. On one end of the upper bracket 131 disposed is a first upper groove unit 133 whose cross-section is semi-circular. On the other end of the upper bracket 131 disposed is a second upper groove unit 134 whose cross-section is semi-circular. On one end of the lower bracket 132 disposed is a first lower groove unit 135 whose cross-section is semi-circular. On the other end of the lower bracket 132 disposed is a second lower groove unit 136 whose cross-section is semi-circular. The first upper groove unit 133 and the first lower groove unit 135 cooperate with each other to form a first light tube interface 137. The second upper groove unit 134 and the second lower groove unit 136 cooperate with each other to form a second light tube interface 138. The whole standpipe 14 is disposed in a chamber 82 formed by the center of the complex, one end thereof is connected to the upper bracket 131, and the other end thereof passes the bottom of the lower cover 3 and enters the lower cover 3. The second end of the first single spiral light tube 6 is embedded into and cooperates with the first light tube interface 137. The second end of the second single spiral light tube 7 is embedded into and cooperates with the second light tube interface 138. The second filament 64 and the fourth filament 74 are connected to the ballast via the lamp wires disposed in the lateral support 13 and the standpipe 14.

An upper connector 15 is disposed on the upper bracket 131. A lower connector 16 is disposed on the lower bracket 132 and cooperates with the upper bracket 131. A fixing groove 17 is disposed on the upper connector 15 for fixing one end of the standpipe 14 and connecting the lateral support 13 with the standpipe 14. The upper connector 15 and the lower connector 16 can be connected conventionally, for example, by a fastening connection.

A first filament connecting plate 51 is disposed in one oblique interface 5 receiving the first end of the first single spiral light tube 6. The first filament 62 is connected to the first filament connecting plate 51. The first filament connecting plate 51 is connected to the ballast via the lamp wires. A second filament connecting plate 52 is disposed in the other oblique interface 5 receiving the first end of the second single spiral light tube 7. The third filament 72 is connected to the second filament connecting plate 52. The second filament connecting plate 52 is connected to the ballast via the lamp wires.

The oblique interface 5 comprises an upper cover unit 53 and a lower base 54 cooperating therewith. A first semi-circular groove 55 is disposed on the upper cover unit 53. A second semi-circular groove 56 is disposed on the lower base 54. The first semi-circular groove 55 cooperates with the second semi-circular groove 56 to form an interface groove 57 matching the first end of the first single spiral light tube 6 or the second single spiral light tube 7.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A lamp comprising:

a) a lamp holder;

b) an upper cover comprising two oblique interfaces;

c) a lower cover;

d) a ballast;

e) a double spiral energy-saving light tube comprising a first single spiral light tube and a second single spiral light tube;

f) a fixing device; and g) a connecting device; wherein the two oblique interfaces are connected to the lower cover and cooperate with one end of the first single spiral light tube and of the second single spiral light tube, respectively;

the first and second spiral energy-saving light tubes have the same structure and are spiral and cylindrical;

the first single spiral light tube rotates into the second spiral light tube following the same direction, whereby forming a cylindrical complex;

the fixing device is disposed on the cylindrical complex for supporting and fixing the first and second single spiral light tube;

one end of the first single spiral light tube and of the second single spiral light tube at one end of the central axis of the complex is received by the two oblique interfaces, respectively;

the connecting device for accommodating lamp wires is disposed between the lower cover and another end of the first and second single spiral light tube at the other end of the central axis of the complex;

a first end of the first single spiral light tube and of the second single spiral light tube is disposed at one end of the central axis of the complex and received by the two oblique interfaces, respectively;

a first exhaust tube and a first filament are disposed on the first end of the first single spiral light tube;

a third exhaust tube and a third filament are disposed on the first end of the second single spiral light tube;

a second end of the first single spiral light tube and of the second single spiral light tube is disposed at the other end of the central axis of the complex;

the connecting device is disposed between the lower cover and the second end of the first single spiral light tube and of the second single spiral light tube;

a second exhaust tube and a second filament are disposed on the second end of the first single spiral light tube;

a fourth exhaust tube and a fourth filament are disposed on the second end of the second single spiral light tube;

an amalgam is disposed in the second and fourth exhaust tubes; and the second end of the first and second single spiral light tube comprises a cold end.

* * * * *